US006832501B2

(12) United States Patent
Gruszka et al.

(10) Patent No.: US 6,832,501 B2
(45) Date of Patent: Dec. 21, 2004

(54) METHOD FOR PRODUCING COMPONENTS USING A FLOWABLE ACTIVE MEDIUM AND A FORMING TOOL

(75) Inventors: Tino Gruszka, Bonen (DE); Franz-Josef Lenze, Dortmund (DE)

(73) Assignee: Thyssenkrupp Stahl AG, Duisburg (DE)

( * ) Notice: Subject to any disclaimer, the term of this patent is extended or adjusted under 35 U.S.C. 154(b) by 0 days.

(21) Appl. No.: 10/240,427

(22) PCT Filed: Apr. 4, 2001

(86) PCT No.: PCT/EP01/03816

§ 371 (c)(1),
(2), (4) Date: Sep. 30, 2002

(87) PCT Pub. No.: WO01/76787

PCT Pub. Date: Oct. 18, 2001

(65) Prior Publication Data

US 2003/0140672 A1 Jul. 31, 2003

(30) Foreign Application Priority Data

Apr. 5, 2000 (DE) ..... 100 16 803

(51) Int. Cl.[7] ..... B21D 26/04; B71D 39/08

(52) U.S. Cl. ..... 72/57; 72/60; 29/421.1

(58) Field of Search ..... 72/57, 58, 60, 72/62; 29/421.1

(56) References Cited

U.S. PATENT DOCUMENTS 5,632,172 A 5/1997 Käsmacher

FOREIGN PATENT DOCUMENTS

DE 197 14 888 A 10/1998
DE 197 32 413 A 2/1999

*Primary Examiner*—David Jones
(74) *Attorney, Agent, or Firm*—Proskauer Rose LLP

(57) ABSTRACT

The invention is for a method to produce components from a blank made of deep-drawable material using a free-flowing action medium. The method consists in clamping the blank in a forming device in which the action medium applies a pressure to the blank, preforming the blank be elevating the pressure exercised by the action medium in restricted areas of the blank and finish forming the preformed blank with a forming tool.

12 Claims, 4 Drawing Sheets

METHOD FOR PRODUCING COMPONENTS USING A FLOWABLE ACTIVE MEDIUM AND A FORMING TOOL

BACKGROUND OF THE INVENTION

The present invention relates to a method for producing components from a blank made of a deep-drawable material, particularly steel, using a free-flowing action medium.

Single blanks formed with the aid of fluid action media, hydroformed welded blanks or similar hollow bodies are suitable for producing complex components with improved properties and for optimizing the properties of the respective blank material used. To form simple blanks with the aid of fluid action media, the final form of the blanks is achieved using a stamp or a comparable forming tool (stamp or matrix) which works against a supporting pressure applied by a fluid cushion. In contrast, hydroforming is carried out by applying a high pressure to a cavity filled with a pressure fluid present between the blanks and/or in the hollow body. In this way, the workpieces are pressed by the so generated internal pressure into a form predetermined by the surrounding matrix.

In many cases it is necessary to produce intermediate forms to generate deep drawn parts or hydroformed parts having complex geometries, since the final contour may not be generated in one forming step. In this case, the intermediate form is carried out in tools which operate independently from the tool used to execute the final form. This partitioning of the tools and of the working steps elevates significantly the costs connected to the production of this type of components.

Intermediate forms can be also fashioned through hydromechanical forming. Accordingly, the blanks are preformed in the forming tool by the action medium before the execution of the main forming. The actual finish forming, during which the final form of the workpiece is achieved, occurs only after the preforming step is finished. For this to occur, however, the preforming geometry must correspond to the outline of the forming tool element. Although this procedure has been shown to be unfavorable with regard to the subsequent main forming, this disadvantage balances out the advantage that greater changes in form in the center of the component could be obtained, so that targeted hardenings may be generated and better exploitation of the properties of the materials could be obtained.

SUMMARY OF THE INVENTION

The object of the present invention is to provide a method to produce components having complex forms while optimizing the properties of the material used.

This object is achieved according to the present invention by a method in which the following steps are performed:

- clamping the blank in a forming device, in which the blank has the action medium applied to it on at least one side;
- preforming the blank by elevating the pressure exercised by the action medium in restricted areas of the blank's surface which represent only portions of a section of the blank surface from which the final form of the component is generated, and
- finish forming the preformed blank using a forming tool.

According to the present invention, partially preformed semi-finished products are generated from the blank in a first working step in a suitable forming device using free-flowing action media. The final form of the component is then generated from this preformed semi-finished product. In this case, the preforming only occurs in one limited region of the blank at a time. In contrast to multi-step drawing of components, the preforming is not used, for example, to implement specific form elements which are further shaped to their final form. Rather, a preform is generated and optimally prepared with consideration to the required properties of the component to be finally produced, to the material deformation and distribution, and with consideration to the exploitation of the material properties. Therefore, according to the present invention, the preform is only generated in those regions where it is required with consideration to the geometric properties (development) and/or to the component-specific properties (strength).

The blanks may be preformed in accord with the requirements of the final product, with or without the aid of a counter-mold. Preforming without a counter-mold has the advantage that the material constituting the blank may flow unimpeded during the preforming, so that, for example, an optimized strength of the preform may be achieved. In addition, the use of a counter-mold has the advantage that the preform may also be optimally prepared with consideration to the spatial arrangement of the final form to be generated. In this case, a balance between free forming and forming entirely in a counter-mold is possible in that only a part of the preformed region of the blank presses against the counter-mold, while free deformation occurs in other regions.

The generation of the component in its final form is preferably executed against a supporting pressure exercised by an action medium. In this way, an exactly shaped, high-quality component with optimized mechanical properties and a good visual appearance may be carefully produced with careful processing.

The blanks preformed according to the present invention may be connected to one another before the finish forming of the component into its final form. In this way, it is possible to manufacture particularly large-area components, or components in which the material distribution and/or the thickness of the material present in the regions of the various blanks is intentionally tailored to the loads of the single components. In this way, the blanks may be connected to one another using material bonding, frictional connection and/or form fit. Alternatively, blanks lying loosely on one another may also be jointly brought into the final form after preforming.

Hollow shapes may also be easily implemented using the method according to the present invention if there is a cavity between the preformed blanks laid on one another and possibly connected to one another. The forms generated in this way are particularly suitable to be executed into their final forms by hydroforming, whereby a high pressure is applied to the cavity during the finish forming of the blanks into their final forms.

BRIEF DESCRIPTION OF THE DRAWINGS:

The invention is further described with reference to the following drawings.

DETAILED DESCRIPTION OF THE INVENTION

Figure 1:
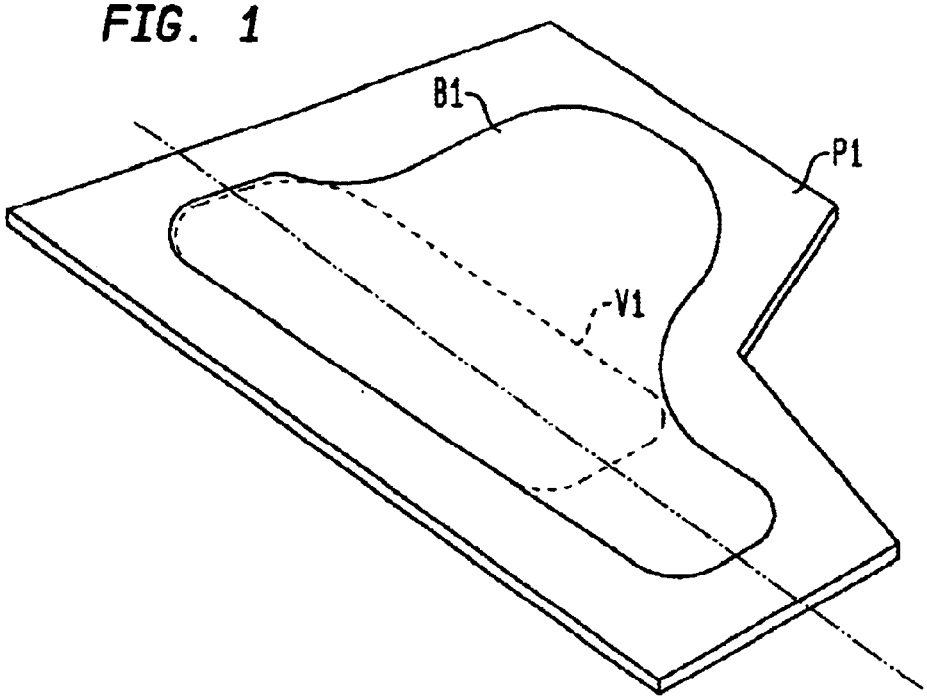
FIG. 1 shows a perspective view of a blank made of the sheet metal.
Figure 4:
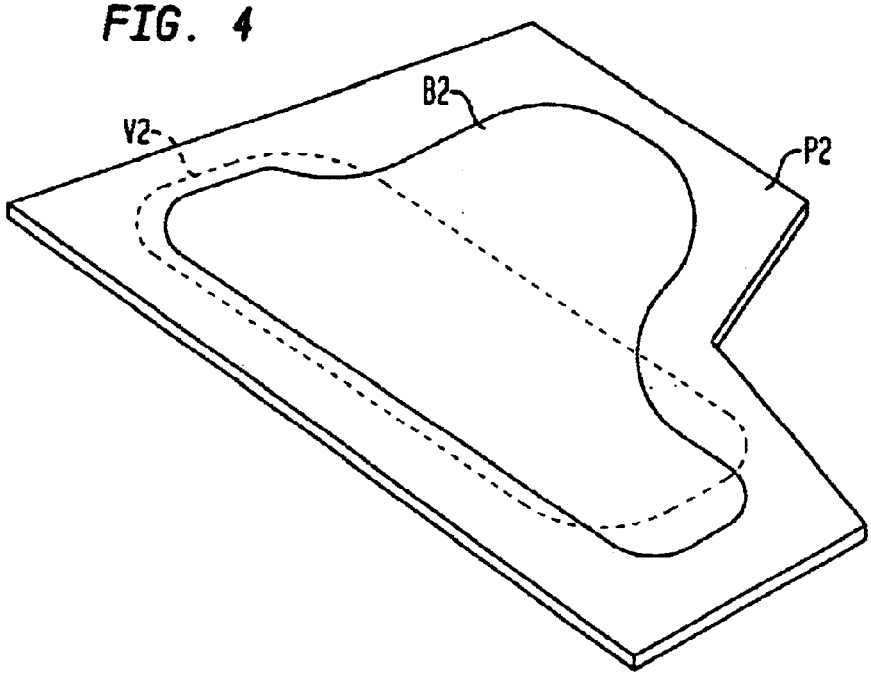
FIG. 4 shows a perspective view of another blank made of thin metal.

In the course of the preparation of the blanks, as shown in FIGS. 1 and 4, the blanks P1, P2 are subdivided into individual regions B1, V1 and/or B2, V2. In this case, a differentiation is made between the regions B1 and/or B2, from each of which the finish formed component is generated, and the regions V1, V2, in which the blanks P1, P2 are preformed.

Figure 5:
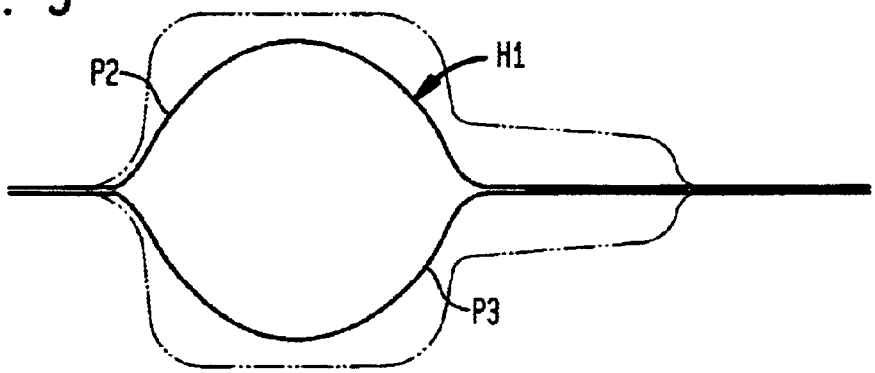
FIG. 5 shows a cross-section of a hollow shape formed by two preformed blanks of the type shown in FIG. 4.
Figure 6:
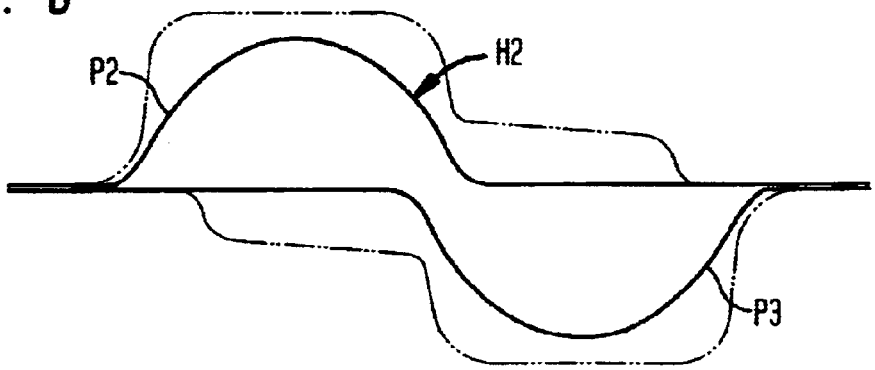
FIG. 6 shows a cross-section of another hollow shape formed by two preformed blanks of the type shown in FIG. 4.

The position of the regions V1 and/or V2 of the blanks P1 and/or P2 is a function of the geometry of the finished component to be generated. Therefore, the development ratio over the cross-section of the finished component shown in FIG. 2 plays a decisive role in the layout of the regions V1, V2. The geometry of the partially preformed blanks P1, P2, and P3, illustrated for exemplary purposes in FIGS. 3, 5, and 6, is laid out to prevent failure for material overloading or for unacceptable wrinkling during the finish forming step.

If necessary, the regions V1 and/or V2 may lie inside the outline of region B1 (FIG. 3), from which the component is finish formed. Its contour is indicated in FIG. 3 by dashed lines and corresponds to that shown in FIG. 2.

For another type of geometry or for other requirements of the properties of the finished formed component, it may also be necessary to preform the blank P2 in a region V2 which goes beyond the sections of respective region B2 from which the component is finished (FIG. 4). However, in this case the region V2 does not correspond completely with the region B2. Instead, in this case, the preforming occurs only in those locations where it is expedient and necessary to have a corresponding preparation of the blanks P1 and/or P2 for the subsequent finish forming. Of course in this case the number of regions provided for preforming is not restricted to one but rather, if necessary, it is possible to establish multiple preform regions on one blank.

The forming devices U1 and U2 are used to preform the blanks P1 and P4, subdivided corresponding to the blank P2 into a region to be preformed and a region from which to generate the final form of the component. Each of these forming devices comprises a container filled with a fluid action medium, for example, water, and is equipped with a holding device 2, which holds the blanks P1, P4 in their edge regions surrounding an opening of the container 1. Thus, the blanks P1 and/or P4 are clamped over the opening, so that the action medium may be applied to the surface facing the inside of the container. Thus, the edge of the opening of the container 1 corresponds to the course of the edge of the region V1 and/or region V2 of the respective processed blanks P1 and P4.

Figure 7:
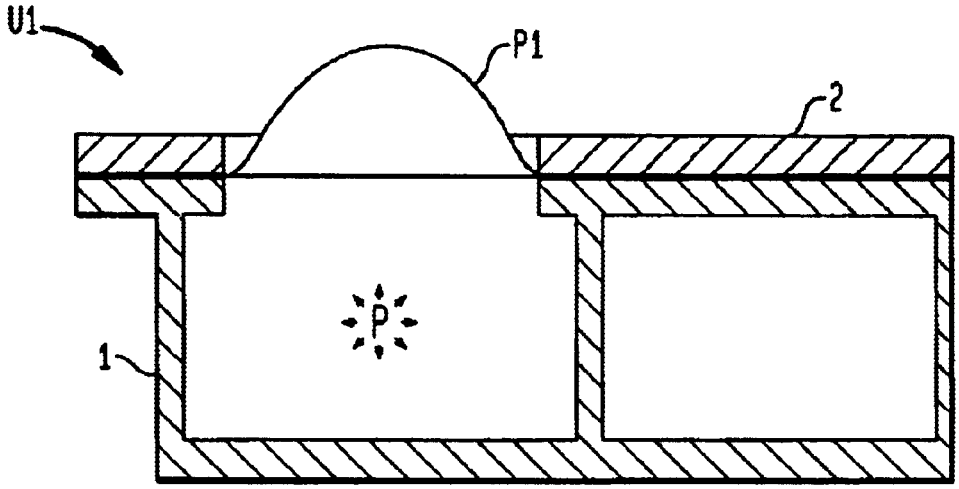
FIG. 7 shows a cross-section of a first device for preforming blanks of the type shown in FIG. 1 or 4.
Figure 8:
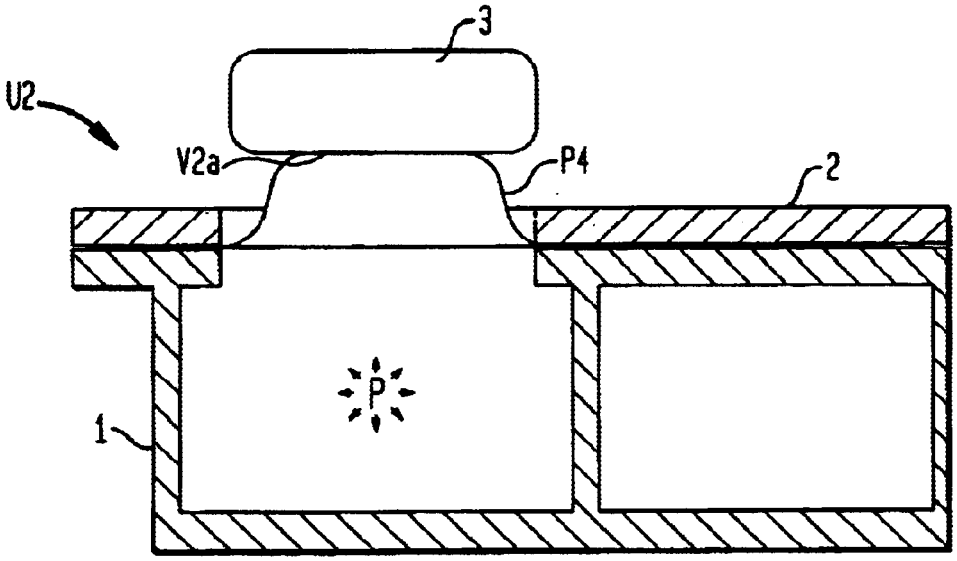
FIG. 8 shows a cross-section of a second device for preforming blanks of the type shown in FIG. 1 or 4.

In contrast to the forming device U1, in which the blank P1 is preformed without a counter-mold (FIG. 7), the forming device U2 is equipped with a counter-mold 3, positioned at a distance to the blank P4, which is clamped over the opening of the container 1 (FIG. 8).

By elevating the pressure P exercised by the action medium, the blanks P1 and/or P4 are arched in the region of the opening of the container with an outward movement. As shown in FIG. 7, the steel material of the blank P1 can flow freely in the forming device U1 until the end of the preforming step. In contrast, FIG. 8 shows that in the forming device U2, the preformed region V2 of blank P4 presses against counter-mold 3 after a certain time of free deformation, so that a section of the preformed region V2 is impressed with the shape of counter-mold 3. The geometry and the dimensions of freely formed section V2*a* of the blank P4 depends on the position of counter-mold 3 in relation to the opening of the container 1.

Figure 2:
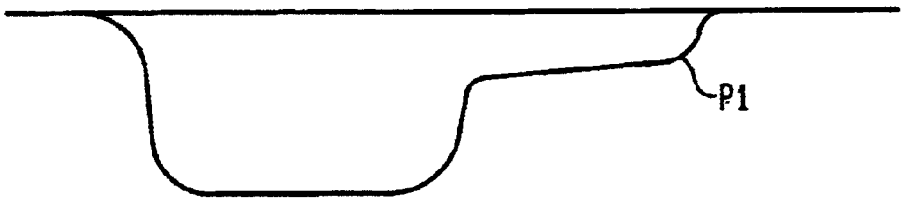
FIG. 2 shows a cross-section of a component formed from the blank.
Figure 3:
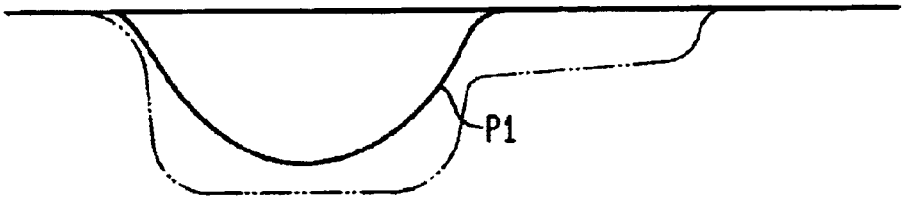
FIG. 3 shows a cross-section of the preformed blank shown in FIG. 2.
Figure 9:
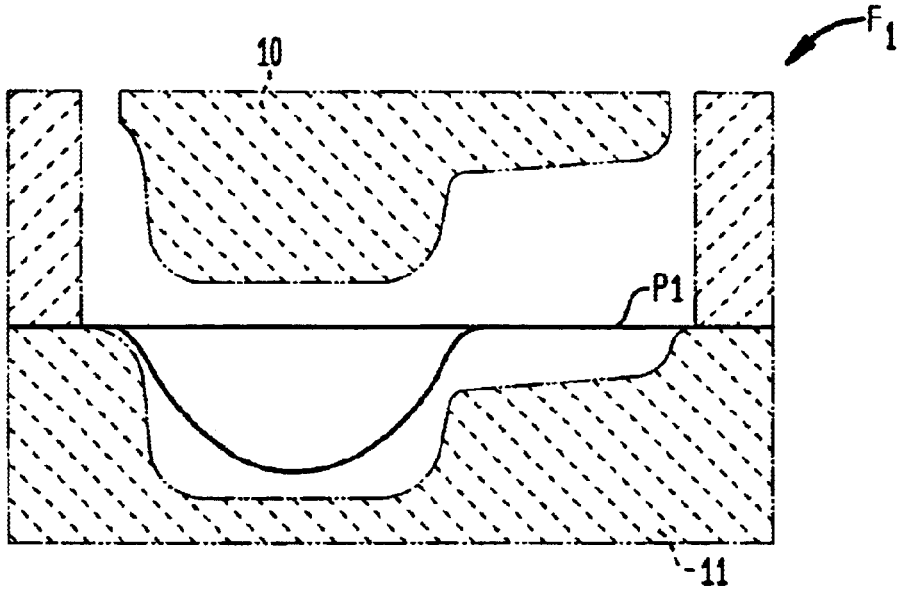
FIG. 9 shows a cross-section of a first device for finish forming of blanks preformed in devices of the type illustrated in FIG. 7 or 8.

After the preforming in the forming devices U1 or U2, the blanks P1-P4 may each be individually finish formed into their respective components (FIG. 2). For this purpose, a device F1, conventionally equipped with a stamp 10 and a matrix 11 may be used as shown in FIG. 9.

Figure 10:
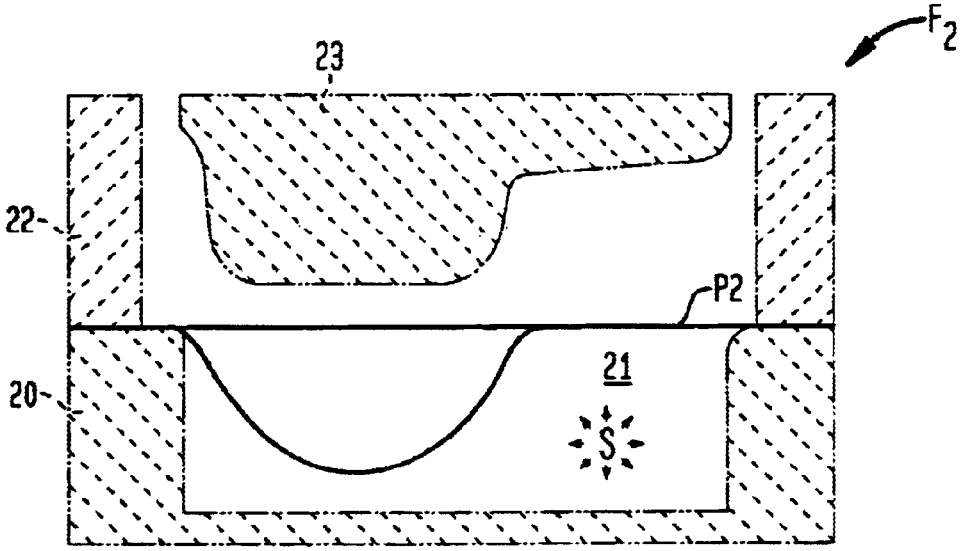
FIG. 10 shows a cross-section of a second device for finish forming of blanks preformed in devices of the type illustrated in FIG. 7 or 8.

Alternatively, the finish forming of blanks P1-P4 may also be carried out in a device F2, which comprises a container 20 for an action medium 21, particularly water, and a holding device 22. For example, FIG. 10 shows the preformed blank P2 being held in the opening of container 20 by the holding device 22.

The finish forming of the blank P2 is then executed using a stamp 23, which may be introduced into the opening of container 20 and on whose surface is molded the shape of the component to be generated. During a working stroke of the stamp 23, the preformed blank P1 is drawn into container 20. At the same time, the action medium contained in container 20 exercises a supporting pressure S directed against the force of stamp 23, so that the preformed blank P1 presses against stamp 23 as its stroke increases and thus receives the shape predetermined by the stamp 23.

It is also possible to lay two blanks P2, P3, preformed in the device U1, on top of one another to form the hollow bodies H1 (FIG. 5) and/or H2 (FIG. 6), each of which comprises the preformed regions V2, V3 on their top and bottom. In this case, the blanks P2, P3 constituting the respective hollow bodies H1, H2 may be welded to one another, to form a unitary module. The form of the components finish formed from the hollow bodies H1, H2 is indicated by the dashed lines in FIGS. 5 and 6.

The preformed hollow bodies H1, H2 may be finish formed particularly well by applying an internal pressure. For this purpose, the hollow bodies H1, H2 are positioned in a matrix of a suitable device, not shown here, and filled with a free-flowing action medium, for example, water. Subsequently, a pressure is applied to the action medium so to expand the sheet metal material of respective hollow body H1, H2, until it presses completely against the walls of the matrix.

List of Reference Numbers

| | |
|---|---|
| 1 | container, |
| 2 | holding device, |
| 3 | counter-mold, |

-continued

| | |
|---|---|
| 10 | stamp, |
| 11 | matrix, |
| 20 | container, |
| 21 | action medium, |
| 22 | holding device, |
| 23 | stamp, |
| F1, F2 | device for finish forming, |
| B1, B2 | region from which the finish forming component is generated, |
| H1, H2 | hollow bodies, |
| P | pressure, |
| P1, P2, P3, P4 | blanks, |
| S | supporting pressure, |
| U1, U2 | forming devices, |
| V1, V2, V3 | region which the preforming of blanks P1, P2 is performed in, |
| V2a | freely deformed section of blank P4, |

What is claimed is:

1. A method to produce components from a blank made of deep-drawable material using a free-flowing action medium, said method comprising:

clamping the blank in a forming device, wherein the blank has the action medium exercising a pressure to it;

preforming the blank by elevating the pressure exercised by the action medium in restricted areas of the blank, wherein said restricted areas only partially cover the surface of the blank from which the final form of the components is generated; and finish forming the preformed blank with a forming tool.

2. The method of claim 1, wherein the deep-drawable material comprises steel.

3. The method of claim 1 further comprising preforming the blank without a counter mold.

4. The method of claim 1, further comprising preforming the blank with a counter mold.

5. The method of claim 4, wherein the restricted areas of the blank partially press against the counter mold at the end of the preforming step.

6. The method of claim 4, wherein preformed regions of the blank press completely against the counter mold at the end of the preforming step.

7. The method of claim 1, further comprising carrying out against a supporting pressure exercised by the action medium the forming of the preformed blank into the final form of the components.

8. The method of claim 1, further comprising connecting at least two blanks to one another after the preforming, and finish forming the blanks jointly into a final form.

9. The method of claim 8, further comprising connecting the preforms to one another by material bonding, friction, form fit and a combination thereof.

10. The method of claim 1, further comprising laying loosely at least two blanks on one another after the preforming step, and finish forming the blanks jointly into a final form.

11. The method of claim 8, wherein a cavity is present between the blanks.

12. The method of claim 11, further comprising applying a high pressure to the cavity during the finish forming of the blanks into the final form.

* * * * *